US007055404B2

(12) United States Patent
Burgstaler et al.

(10) Patent No.: US 7,055,404 B2
(45) Date of Patent: Jun. 6, 2006

(54) RETURN DEVICE FOR THE PEDALS OF A MOTOR VEHICLE

(75) Inventors: Andree Burgstaler, Dielingen (DE); Jan Dütz, Damme (DE); Simone Pätzold, Cappeln (DE)

(73) Assignee: ZF Lemförder Metallwaren AG, Stemwede-Dielingen (DE)

( * ) Notice: Subject to any disclaimer, the term of this patent is extended or adjusted under 35 U.S.C. 154(b) by 136 days.

(21) Appl. No.: 10/240,605

(22) PCT Filed: Jan. 31, 2002

(86) PCT No.: PCT/DE02/00330

§ 371 (c)(1),
(2), (4) Date: Oct. 1, 2002

(87) PCT Pub. No.: WO02/061520

PCT Pub. Date: Aug. 8, 2002

(65) Prior Publication Data

US 2003/0097899 A1 May 29, 2003

(30) Foreign Application Priority Data

Feb. 2, 2001 (DE) ..... 101 05 265

(51) Int. Cl.
*G05G 1/14* (2006.01)

(52) U.S. Cl. ..... 74/512; 74/513; 74/514; 74/560

(58) Field of Classification Search ..... 74/512, 74/513, 514, 560; G05G 1/14
See application file for complete search history.

(56) References Cited

U.S. PATENT DOCUMENTS

| | | | | |
|---|---|---|---|---|
| 6,070,490 | A | 6/2000 | Aschoff et al. | |
| 6,186,025 | B1 * | 2/2001 | Engelgau et al. | 74/512 |
| 6,240,801 | B1 * | 6/2001 | Kojima et al. | 74/513 |
| 6,289,762 | B1 * | 9/2001 | Silva | 74/513 |
| 6,295,891 | B1 | 10/2001 | Velte et al. | |
| 6,725,741 | B1 * | 4/2004 | Menzies | 74/514 |
| 6,860,170 | B1 * | 3/2005 | DeForest | 74/512 |

FOREIGN PATENT DOCUMENTS

| | | |
|---|---|---|
| DE | 694 08 945 | 6/1998 |
| DE | 197 51 520 | 10/1999 |
| EP | 0 943 835 | 9/1999 |
| EP | 1 033 275 | 9/2000 |
| GB | 2 349 447 | 11/2000 |

* cited by examiner

*Primary Examiner*—Vinh T. Luong
(74) *Attorney, Agent, or Firm*—McGleww & Tuttle, P.C.

(57) ABSTRACT

A resetting device for pedals of a motor vehicle is provided with a spring element (6), which is fixed on a mount (9) at the pedal (1), on the one hand, and, on the other hand, at a corresponding mount (10). At least one spring-loaded friction element (12) is provided with at least one friction surface pair (13, 14). The friction surface pair (13, 14) is arranged between the pedal (1) and the body of the motor vehicle.

14 Claims, 3 Drawing Sheets

RETURN DEVICE FOR THE PEDALS OF A MOTOR VEHICLE

FIELD OF THE INVENTION

The present invention pertains to a resetting device for pedals of a motor vehicle, which pedals are mounted on an axis of rotation, with a spring element, which is fixed on a mount at the pedal, on the one hand, and, on the other hand, on a mount that is rigidly connected to the body.

BACKGROUND OF THE INVENTION

Various designs of pedals of a motor vehicle for actuating the brake, clutch and gas with have been known from the state of the art. The spring elements usually comprise tension springs, which are hung with one of their ends into a mounting device at the pedal and the other free end is articulated to a hook or the like on the body. Besides tension springs, resetting devices equipped with compression springs have also been known, especially in the case of resetting devices for electronic module units for scanning the position of the gas pedal and transmitting the data thus obtained to downstream assembly units (E gas modules). Due to the springs used, there is a hysteresis effect between the pedal actuation by the user and the resetting movement by the articulated spring, which is decisive for the feeling of actuation during the use of the pedal arrangement in question. The hysteresis occurring and consequently the pedal feel resulting therefrom is set in the resetting devices known from the state of the art by the predetermined springs and is consequently not adjustable or variable. Moreover, the resetting devices of this type do not have the possibility of increasing the hysteresis between the two actuation directions of the pedal in question.

SUMMARY OF THE INVENTION

The object of the present invention is therefore to improve a resetting device of the type corresponding to this class for pedals of motor vehicles such that the hysteresis between the actuation directions of the pedal, which is caused by the resetting springs used, can be made variable with a simple design and in an inexpensive manner.

Thus, a possible solution according to the present invention is seen in that at least one spring-loaded friction element with at least one friction surface pair, which comprises mutually corresponding friction surfaces, is arranged between the pedal and the body.

According to another suggestion, provisions are made, moreover, for arranging between the pedal and the body at least one spring-loaded friction element with at least one friction surface pair, which comprises mutually corresponding friction surfaces, which form an acute angle of skew with the plane of rotation of the pedal.

In conjunction with the friction surfaces, which are designed, e.g., as planes or as surfaces with a curved shape, the friction element guarantees an increase in the hysteresis between the actuation direction of the pedal and its resetting movement. Regardless of the resetting springs used, differently dimensioned springs can be used here in the friction element without problems, and the rates of the springs guarantee, in conjunction with different angles of skew, an individual adaptation of the feeling of actuation of the pedal to different requirements. In addition, an additional damping of the resetting movement of the pedal can be brought about by the design according to the present invention.

It proved to be particularly advantageous in this connection for the angle of skew between the plane of the friction surface and the plane of rotation of the pedal to have a value in the range of 0.5–10°.

Provisions are made in an inexpensive design for the friction element to be formed from two cylindrical sections of different diameters, which adjoin one another, wherein the cylindrical section with the smaller diameter is designed as a mount, which receives a compression spring, and the cylindrical section with the larger diameter has the friction surface on its free front surface facing away from the other section. According to the present invention, the cylindrical section with the larger diameter may be a cylinder cut off obliquely as well as a circular cylinder cut off obliquely.

This design protects, on the one hand, the compression spring for generating the frictional forces from buckling movements and, on the other hand, the necessary friction surface on the front side of the cylindrical section with the larger diameter can be dimensioned as a sufficiently large surface, and a compact, space-saving design of the entire friction element can be guaranteed. In the design being described, the friction element is mounted, if necessary, in a pot-shaped mount, which is designed as an integral component of the corresponding motor vehicle pedal, and the second friction surface corresponding to the friction surface of the friction element is arranged on the side of the pedal, e.g., on a holding device for the said pedal.

An exemplary embodiment of the present invention will be explained in greater detail below on the basis of the drawings attached. In the view in the figures, individual areas were shown only as details, so that a synoptic view of the motor vehicle pedal including its mounting or mount at the body is not shown.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
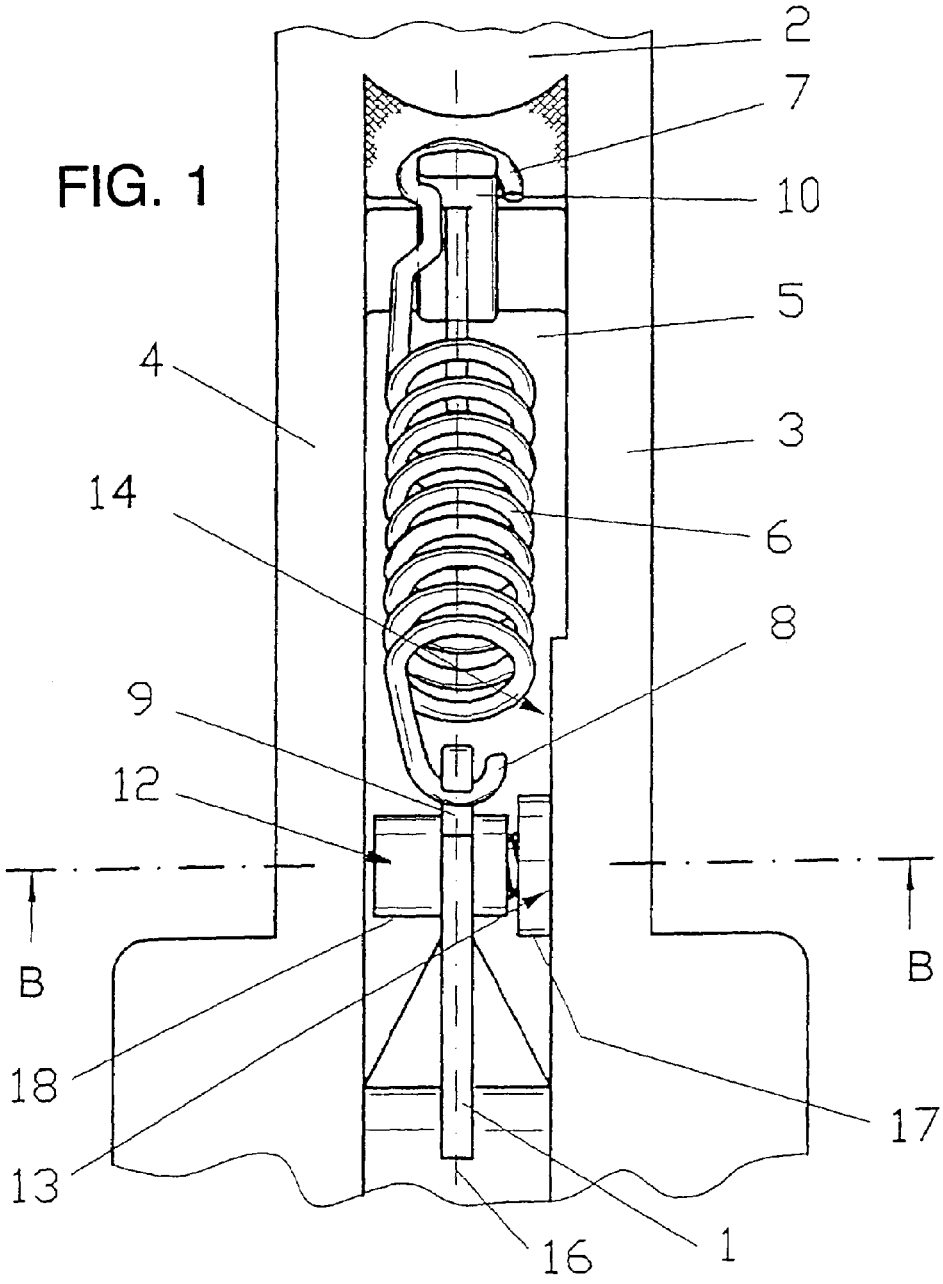
FIG. 1 is a perspective front view of the resetting device according to the present invention.

Referring to the drawings in particular, FIG. 1 shows the top part of a pedal 1, preferably for the actuation of an E gas module. The pedal 1 is mounted here in a pedal bracket 2 connected to the body of the motor vehicle. In the exemplary embodiment being shown, the pedal bracket 2 has two lateral walls 3, 4, which define between them an elongated hole 5, in which the upper part of the pedal 1 is accommodated, on the one hand. Moreover, the slot 5 also accommodates a spring element 6 designed as a tension spring for generating resetting forces for the pedal 1. The spring element 6 has hooks 7, 8 at its free ends for articulating the spring element 6 to a pedal-side mount 9, on the one hand, and to a body-side mount 10, on the other hand. During the rotation of the pedal 1 around an axis of rotation 11 located between the walls 3 and 4 (see FIG. 2), the spring element 6 is elongated and pulls the pedal 1 back into its starting position after the end of the deflecting movement due to its spring action.

The resetting device shown is equipped according to the present invention with a spring-loaded friction element 12. The friction element 12 is arranged between the pedal 1 and the wall 3 in the embodiment being shown, and the spring 19 (see FIG. 2 or 3) of the friction element 12, being a compression spring, generates frictional forces in a friction surface pair with the corresponding friction surfaces 13 and 14. The friction surface 13 is now on the outer side of a cylindrical section 17 of the friction element 12. The associated friction surface 14 is provided on the inner side of the wall 3. The friction surface 14 forms a bevel (see FIG. 3), which forms an acute angle $\alpha$ with the plane of rotation 16, which is indicated by dash-dotted line in FIG. 3 to illustrate its position. During the rotation of the pedal 1 and a displacement of the friction element 12 along the friction surface 14, which displacement is associated therewith, the frictional forces generated by the friction element 12 become stronger as a consequence of the reduction of the distance between the friction surface 14 on the wall 3 and the plane of rotation 16 of the pedal 1, because the spring action of the compression spring 19 of the friction element 12 increases hereby.

Figure 2:
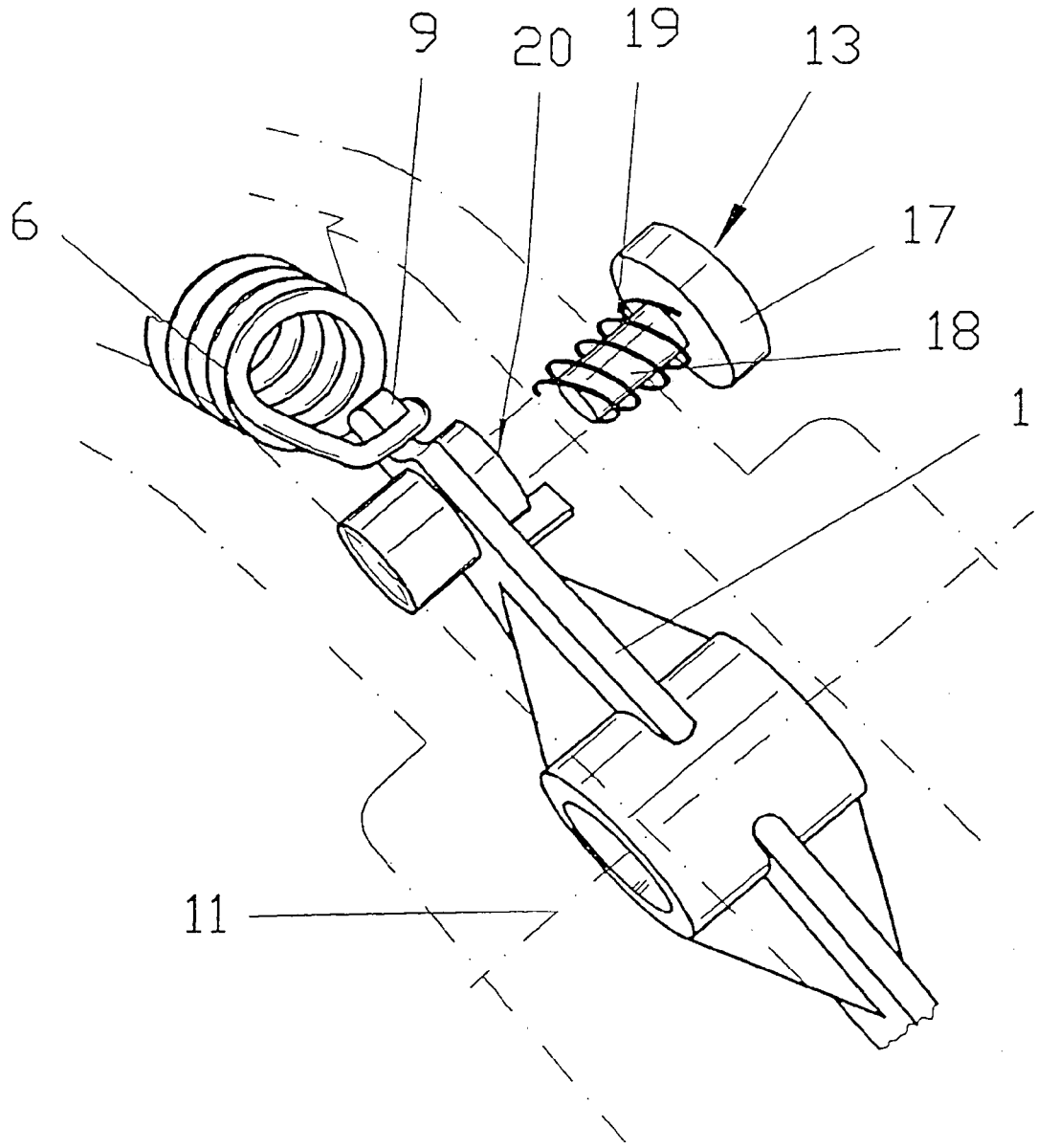
FIG. 2 is an exploded view of the resetting device from FIG. 1 from another angle of view.
Figure 3:
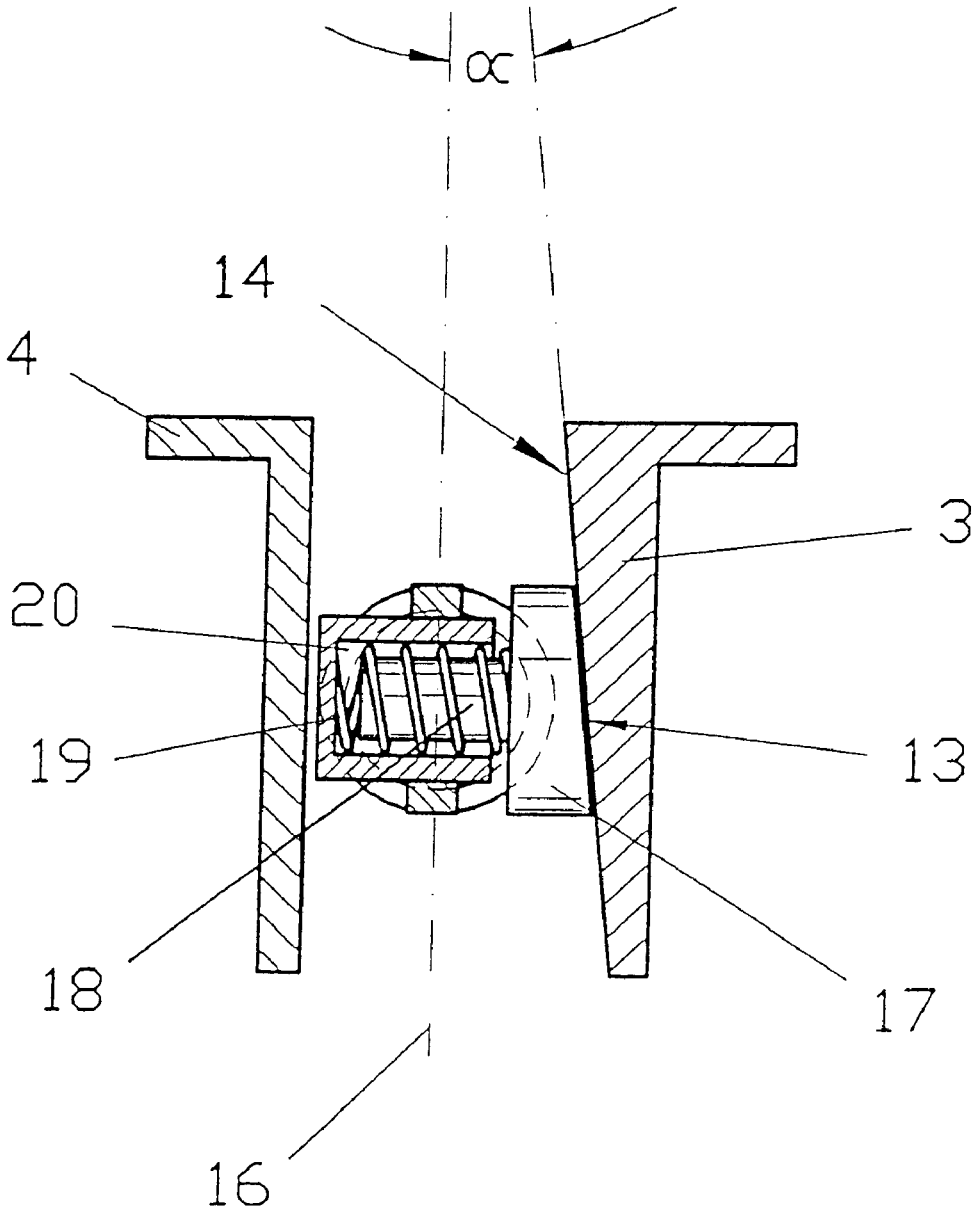
FIG. 3 is a sectional view along line B—B in FIG. 1.

The design of the friction element 12 is shown in FIG. 2 for illustration (however, without the friction surface 14). The friction element 12 has cylindrical sections 17 and 18. The cylindrical section 18 has a smaller diameter than the adjoining section 17, at the free end of which, which faces away from the section 18, the friction surface 13 is located. The cylindrical section 18 is used to receive a compression spring 19, which is supported on a front surface of the cylindrical section 17, on the one hand, and, on the other hand, at the bottom of a mounting hole 20, which is prepared in the pedal body in the upper part of the pedal 1 adjacent to the mount 9 for the spring element 6, the mounting hole 20 being provided in a pot-shaped thickened part of the pedal body.

To generate frictional forces of varying strengths, this compression spring 19 may be provided in different designs and with different rigidities in the friction element. Moreover, the design of the oblique friction surface 14 offers the possibility of making the pedal feel during the pivoting of the pedal correspondingly variable by increasing or decreasing the friction forces. The skew of the friction surface 13 on the friction element 12 is adapted to the friction surface 14. Another possibility of varying the properties of the friction surface is to correspondingly select the friction pair, i.e., the material of the surfaces that are in contact with one another.

While specific embodiments of the invention have been shown and described in detail to illustrate the application of the principles of the invention, it will be understood that the invention may be embodied otherwise without departing from such principles.

The invention claimed is:

1. A motor vehicle pedal resetting device, comprising:

a mount rigidly connected to a motor vehicle body;

a pedal mounted on an axis of rotation and with a pedal mount;

a spring element fixed to said pedal mount and to said mount rigidly connected to the motor vehicle body, a friction element with at least one friction surface pair comprising corresponding friction surfaces arranged between said pedal and the motor vehicle body, said friction element being arranged spaced from said axis of rotation, said friction element includes a compression spring biasing one of said friction surfaces against another of said friction surfaces, said compression spring being separate from said spring element.

2. A device in accordance with claim 1, wherein:

a portion of said friction element is mounted on said pedal.

3. A device in accordance with claim 1, wherein:

said pedal defines a hole and a portion of said frictional element is mounted in said hole.

4. A device in accordance with claim 1, wherein;

said friction element is formed from two mutually adjacent cylindrical sections of different diameters, wherein a first of said cylindrical sections accommodates said compression spring and a second of said cylindrical sections of a larger of said diameters has one of said friction surfaces on a front surface facing away from said first cylindrical section, and said first cylindrical section being mounted in a mounting hole of said pedal.

5. A device in accordance with claim 1, further comprising:

a pedal bracket connected to the motor vehicle body, said pedal being rotatably mounted on said pedal bracket about said axis of rotation.

6. A device in accordance with claim 5, wherein:

said pedal bracket includes two lateral walls defining an elongated hole, said pedal being arranged in said elongated hole, one of said frictional surfaces being provided on an inner side of one of said lateral walls.

7. A device in accordance with claim 6, wherein:

said frictional element is arranged between said one of said lateral walls and said pedal.

8. A device in accordance with claim 5, wherein:

said pedal bracket includes two lateral walls defining an elongated hole, said pedal being arranged in said elongated hole, another one of said frictional surfaces being provided on an inner side of one of said lateral walls.

9. A motor vehicle pedal resetting device, comprising:

a mount rigidly connected to a motor vehicle body;

a pedal rotatably mounted on an axis of rotation in a plane of rotation, said pedal including a pedal mount;

a spring element fixed to said pedal mount and to said mount rigidly connected to the motor vehicle body;

a spring-loaded friction element with at least one friction surface pair comprising corresponding friction surfaces forming an acute angle of skew with a plane of rotation of said pedal, said friction element being arranged between said pedal and the motor vehicle body, said friction element being arranged spaced from said axis of rotation.

10. A motor vehicle pedal resetting device in accordance with claim 9, wherein the angle of skew has a value in the range of 0.5–10°.

11. A motor vehicle pedal resetting device in accordance with claim 9, wherein said friction element is formed from two mutually adjacent cylindrical sections of different diameters, wherein a first of said cylindrical sections accommodates a compression spring and a second of said cylindrical sections of a larger diameter has one of said friction surfaces on a front surface facing away from said first cylindrical section, and said first cylindrical section being mounted in a mounting hole of said pedal.

12. A pedal resetting arrangement comprising:

a pedal bracket rigidly connectable to a motor vehicle body, said pedal bracket including a wall;

a pedal rotatably mounted on said pedal bracket about an axis of rotation between first and second positions, said pedal defining a hole;

a spring element connected to said pedal, said spring element biasing said pedal towards said first position;

a friction device including a first friction surface movable with said pedal and a second friction surface fixed with respect to said bracket, said second frictional surface being arranged on said wall, said first and second friction surfaces being arranged to slide against each other when said pedal rotates between said first and second positions, said frictional device including a spring biasing said first frictional surface against said second frictional surface, said friction device being arranged radially offset from said axis of rotation, said friction device including a frictional element mounted on said pedal, said frictional element including said first frictional surface, said frictional element being arranged between said wall and said pedal, said frictional element being movably mounted in said hole of said pedal in a direction of said axis of rotation.

13. An arrangement in accordance with claim 12, wherein:

said pedal bracket includes another wall spaced from said wall, said pedal being arranged between said wall and said another wall, said second frictional surface being arranged on a side of said wall facing said pedal and said another wall.

14. An arrangement in accordance with claim 12, wherein:

said pedal rotates in a rotational plane, said first and second frictional surfaces are angularly spaced from said rotational plane.

* * * * *